US010131472B2

(12) United States Patent
Asai et al.

(10) Patent No.: US 10,131,472 B2
(45) Date of Patent: Nov. 20, 2018

(54) VIAL RUBBER STOPPER

(75) Inventors: Takashi Asai, Osaka (JP); Tadatoshi Uchida, Osaka (JP); Masanobu Iwasa, Osaka (JP); Ryouji Komatsu, Yurihonjo (JP)

(73) Assignee: NIPRO CORPORATION, Osaka-shi, Osaka (JP)

( * ) Notice: Subject to any disclaimer, the term of this patent is extended or adjusted under 35 U.S.C. 154(b) by 381 days.

(21) Appl. No.: 13/997,513

(22) PCT Filed: Dec. 28, 2010

(86) PCT No.: PCT/JP2010/073807

§ 371 (c)(1),
(2), (4) Date: Jun. 24, 2013

(87) PCT Pub. No.: WO2012/090328

PCT Pub. Date: Jul. 5, 2012

(65) Prior Publication Data

US 2013/0270271 A1 Oct. 17, 2013

(51) Int. Cl.

| | |
|---|---|
| ***B65D 39/00*** | (2006.01) |
| ***A61J 1/14*** | (2006.01) |
| ***B65D 51/00*** | (2006.01) |

(52) U.S. Cl.

CPC ..... *B65D 39/0052* (2013.01); *A61J 1/1406* (2013.01); *B65D 39/007* (2013.01); *B65D 51/002* (2013.01)

(58) Field of Classification Search

USPC ..... 215/247, 364, 800–802, DIG. 19; 220/277

See application file for complete search history.

(56) References Cited

U.S. PATENT DOCUMENTS

| | | | | |
|---|---|---|---|---|
| 4,465,200 | A * | 8/1984 | Percarpio | 215/247 |
| 2006/0054586 | A1 * | 3/2006 | Sudo et al. | 215/355 |

(Continued)

FOREIGN PATENT DOCUMENTS

| | | | |
|---|---|---|---|
| CN | 1795026 | A | 6/2006 |
| EP | 0 454 493 | A2 | 10/1991 |

(Continued)

OTHER PUBLICATIONS

ASKER http://www.asker.co.jp/en/products/durometer/micro/md-1-capa/index.html.*

(Continued)

*Primary Examiner* — Anthony Stashick
*Assistant Examiner* — Mollie Impink
(74) *Attorney, Agent, or Firm* — Birch, Stewart, Kolasch & Birch, LLP

(57) ABSTRACT

Provided is a vial rubber stopper using multiple types of rubber to prevent the vial rubber stopper from being scraped and from sticking to a presser plate. The vial rubber stopper includes: a cap portion having a flange; a piercing area formed to have a recess at a top surface of the cap portion and configured to traverse longitudinally the cap portion in an axial direction from the recess to a bottom surface of the cap portion; and a leg portion formed on the bottom surface of the cap portion in a way of extending downward and located outside the piercing area with respect to an axial center of the cap portion. The piercing area is formed of rubber having rubber hardness from 20 to 35, and the top surface other than the recess of the cap portion is formed of rubber having rubber hardness from 58 to 90.

6 Claims, 4 Drawing Sheets

(a)

(b)

(56) References Cited

U.S. PATENT DOCUMENTS

| | | | |
|---|---|---|---|
| 2006/0175280 | A1 | 8/2006 | Anraku et al. |
| 2007/0066941 | A1 | 3/2007 | Tezuka et al. |

FOREIGN PATENT DOCUMENTS

| | | | |
|---|---|---|---|
| EP | 1 066 881 | A2 | 1/2001 |
| JP | 55-101758 | U | 7/1980 |
| JP | 3-97450 | A | 4/1991 |
| JP | 2001-219949 | A | 8/2001 |
| JP | 2002-65810 | A | 3/2002 |
| JP | 2002-306569 | A | 10/2002 |
| JP | 2004-24384 | A | 1/2004 |
| JP | 2004-123121 | A | 4/2004 |
| JP | 2004-215860 | A | 8/2004 |
| JP | 2004-231216 | A | 8/2004 |
| WO | WO 2004/103453 | A1 | 12/2004 |

OTHER PUBLICATIONS

Teclock brochure: Rubber Hardness Tester Durometer, p. 4, http://www.teclock.com.jp/.*

Shore Durometers: Durometer Selection guide, Mar. 11, 2006, http://web.archive.org/web/20060311221520/http://ccsi-inc.com/p-durometer-shoreselect.htm.*

European Communication under Rule 71(3) EPC for European Application No. 10861474.4, dated Jul. 5, 2018.

Kobunshi Keiki Co., Ltd., "ASKER Durometer Type A," http://www.asker.co.jp/en/products/durometer/analog/a, Publication Date Unknown, Retrieval date of Jun. 7, 2018, pp. 1-3.

* cited by examiner (a)

(b)

(a)

(b)

VIAL RUBBER STOPPER

TECHNICAL FIELD

The present invention relates to a vial rubber stopper, and more particularly to a vial rubber stopper suitable for production and/or use of a freeze-dried medical agent.

BACKGROUND ART

A vial or an ampule is used as a container for storing a little amount of drug solution. The vial, mainly a small container made of glass, plastics or the like, is sealed with an opening portion of the container being capped by a rubber stopper. Since it is possible to have a device such as a syringe or the like communicated with the container by inserting a hollow needle through the rubber stopper without breaking (or destroying) the sealing of the container, the operation can be performed hygienically without opening the container imprudently. Therefore, such vial is used as a container for various types of medical agents no matter it is a liquid medical agent or a powder medical agent.

Generally, a vial is produced according to the following procedure. A predefined amount of medical agent is filled into a cylindrical container having an upper portion thereof opened, and a leg portion of the rubber stopper is softly inserted into the opening (half capped). A plurality of such prepared vials are capped in a capper. (In the case of a vial containing a freeze-dried drug product, the vial is put into a freeze dryer at the half capped state to freeze-dry the drug product, and thereafter the vial is capped in a capper.) The capping is performed by lowering a presser plate from the upper side to press the rubber stopper into the vial.

Vials are used and produced as mentioned above; however, use requirements are contradictory to production requirements. In the use, the rubber stopper is pierced through by a hollow needle. If rubber hardness is high, at the time when the hollow needle pierces the rubber stopper, the rubber stopper will be scrapped, resulting in the so-called coring, and it is possible that minute pieces of rubber (impurities) will fall into the vial. Therefore, from the viewpoint of preventing the coring, it is desired to decrease the hardness of the portion to be pierced by the hollow needle.

On the contrary, in the production, the presser plate and the rubber stopper are pressed to contact each other in a capping step. If a top surface of the rubber stopper sticks to the presser plate, at the time when the presser is elevated, the vial will be elevated together with the rubber stopper; as the elevated vial falls down, it may break, which may make the whole lot unusable. Therefore, from the viewpoint of preventing the presser plate and the rubber stopper from sticking to each other, it is desired to increase the hardness of the top surface of the rubber stopper.

In order to offer multiple functions to a rubber stopper, the rubber stopper is formed of multiple rubber materials, such as the one disclosed in Japanese Patent Laying-Open No. 2004-231216. From the viewpoint of keeping medical agents stable for a long term in a vial and preventing the rubber stopper from being degenerated by the medical agents, the vial is entirely formed of chlorinated polyethylene rubber, chlorosulfonated polyethylene rubber or the like; and in order to compensate for resealing capability of a pierced hole which is not possessed by the multiple rubber materials, the portion to be pierced by the needle is formed of natural rubber, isoprene rubber or butadiene rubber.

CITATION LIST

Patent Document

PTD 1: Japanese Patent Laying-Open No. 2004-231216

SUMMARY OF INVENTION

Technical Problem

However, taken into consideration the prevention of the coring and the sticking to the presser plate, the configuration of the rubber stopper of PTD1 is insufficient. The rubber stopper of PTD1 prevents the sticking to the presser plate through the way of providing a projection on the top surface of a cap portion; however, in actual use, it is impossible to prevent the sticking to the presser plate merely by providing a projection on the top surface, thereby, the vial is still in the risk of breaking. Moreover, it is suggested that the portion to be pierced by the needle is formed of natural rubber, isoprene rubber, butadiene rubber or the like on the consideration of the resealing capability; however, since these rubber materials have great gas permeability, the connection of the interior portion of the vial and the exterior air through the intermediary of these rubber materials may carry an adverse influence on the state of medical agents stored in the vial. As a solution to the coring, a high elastic rubber must be disposed to traverse longitudinally from the top surface to a bottom surface of the cap portion; thereby, it is not desired to use these rubber materials. Therefore, under the precondition of maintaining the storage stability of medical agents (degeneration of medical agents, deterioration of the rubber stopper and the like) in the vial, it is desired to produce a vial rubber stopper in combination with such kind of rubber capable of preventing the sticking to the presser plate and the occurrence of the coring.

An object of the present invention is to provide a vial rubber stopper free from sticking to the presser plate and the occurrence of the coring by using multiple types of rubber.

After keen examinations, the inventors of the present invention figured out the following invention. A vial rubber stopper includes a cap portion having a flange, a piercing area formed to have a recess at a top surface of the cap portion and configured to traverse longitudinally the cap portion from the recess to a bottom surface of the cap portion, and a leg portion formed on the bottom surface of the cap portion in a way of extending downward and located outside the piercing area with respect to an axial center of said cap portion. The piercing area is formed of rubber having rubber hardness from 20 to 35, and the top surface other than the recess of the cap portion is formed of rubber having rubber hardness from 58 to 90.

Further, it is acceptable that the vial rubber stopper, excluding the top surface other than the recess of the cap portion, is formed of rubber having rubber hardness from 20 to 35, and it is also acceptable that the vial rubber stopper, excluding the top surface other than the recess and a side portion of the cap portion, is formed of rubber having rubber hardness from 20 to 35. Furthermore, it is acceptable that the vial rubber stopper, excluding the top surface other than the recess and the flange of said cap portion, is formed of rubber having rubber hardness from 20 to 35.

According to the vial rubber stopper mentioned above, since the top surface of the cap portion being pressed by the presser plate is formed of rubber having high rubber hardness and the portion to be pierced by the hollow needle is formed of rubber having low rubber hardness, the sticking to the presser plate can be prevented and the occurrence of the coring can be avoided. Thereby, the present invention has been achieved for the purpose of preventing the vial from breaking in the production and preventing the minute rubber pieces from being mixed into medical agents in the use.

Advantageous Effects of Invention

The vial rubber stopper of the present invention is free from sticking to the presser plate and the occurrence of the coring, and thus it is preferably applicable to medical services.

DESCRIPTION OF EMBODIMENTS

Figure 1:
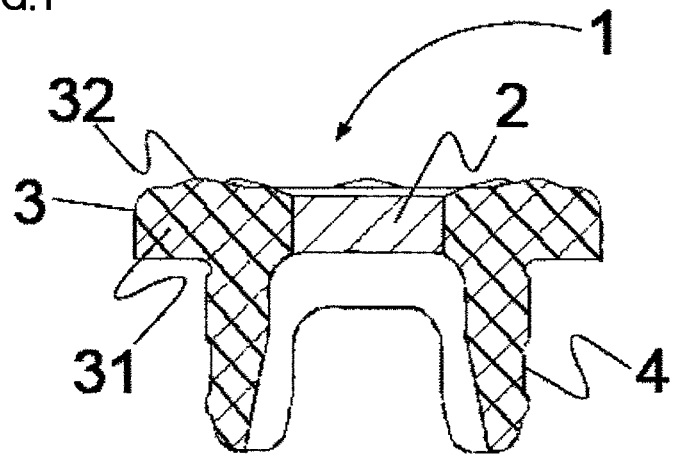
FIG. 1 illustrates a vial rubber stopper according to an embodiment of the present invention, in which (b) is a view of a top surface and (a) is a schematic cross-sectional view taken along a line I-I in (b)
Figure 1:
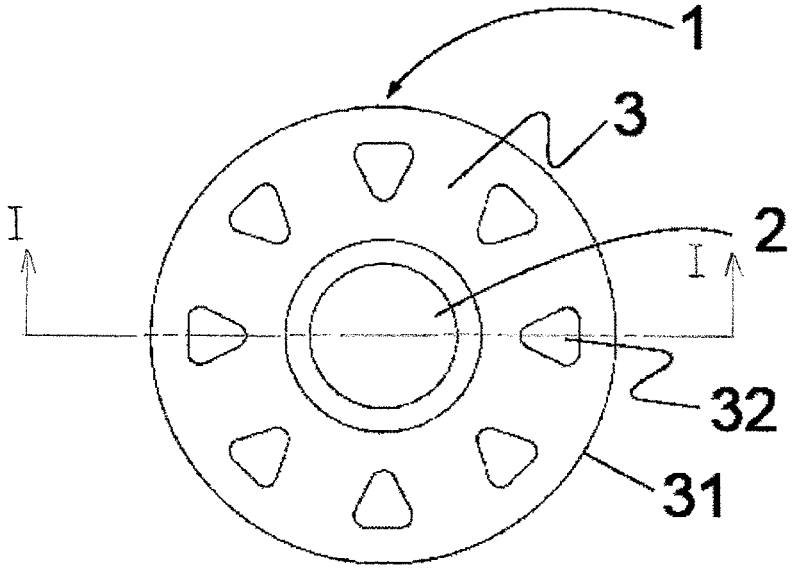

Hereinafter, a vial rubber stopper of the present invention will be described with reference to the drawings. It should be noted that the present invention is not limited to embodiments illustrated in the drawings.

Figure 2:
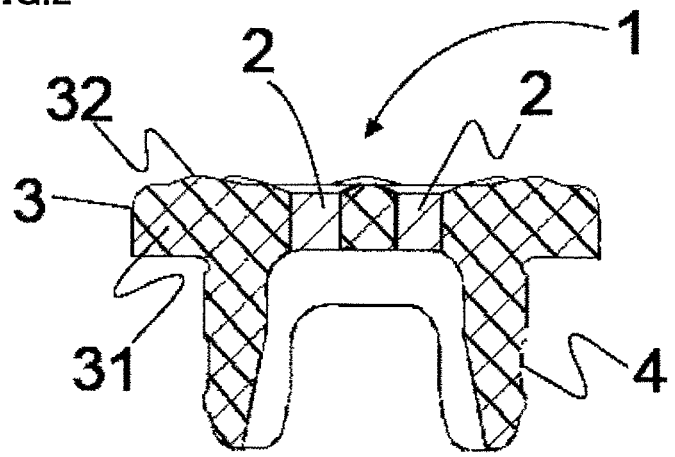
FIG. 2 illustrates a vial rubber stopper according to another embodiment of the present invention, in which (b) is a view of a top surface and (a) is a schematic cross-sectional view taken along a line II-II in (b)
Figure 2:
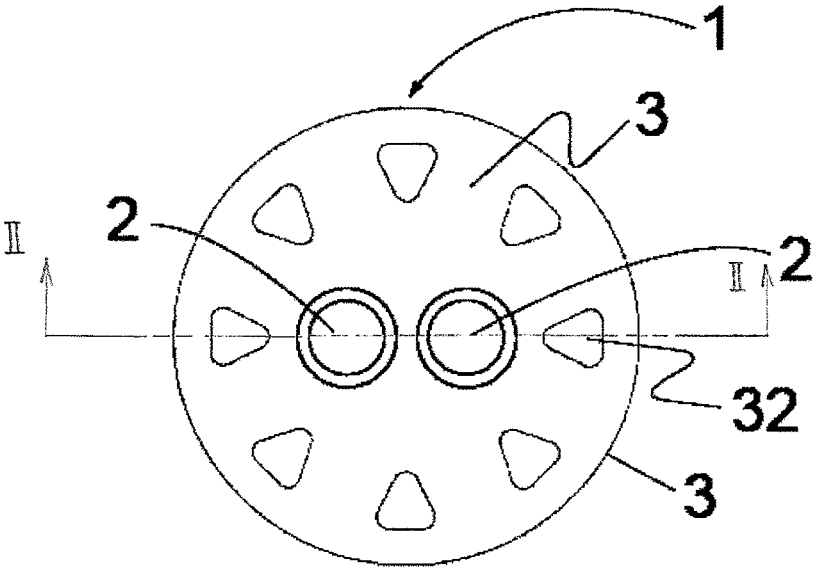
Figure 3:
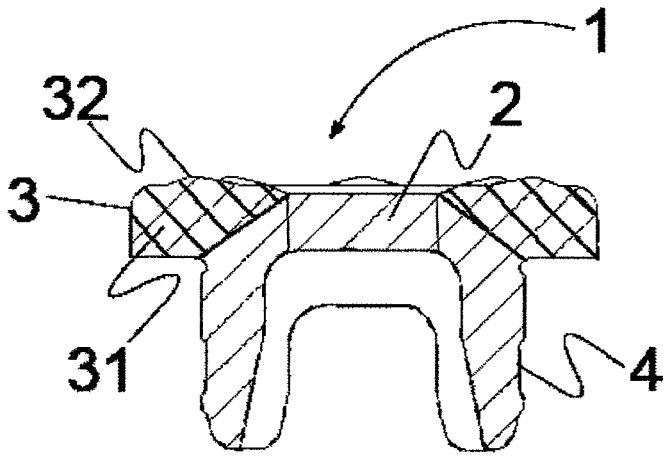
FIG. 3 is a longitudinal sectional view of a vial rubber stopper according to another embodiment of the present invention.
Figure 4:
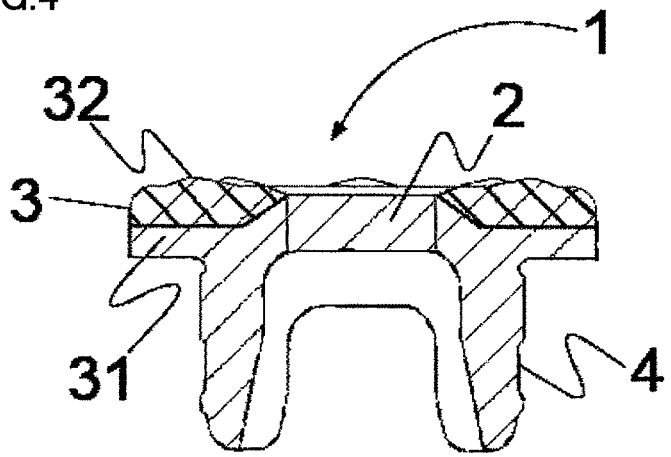
FIG. 4 is a longitudinal sectional view of a vial rubber stopper according to another embodiment of the present invention.
Figure 5:
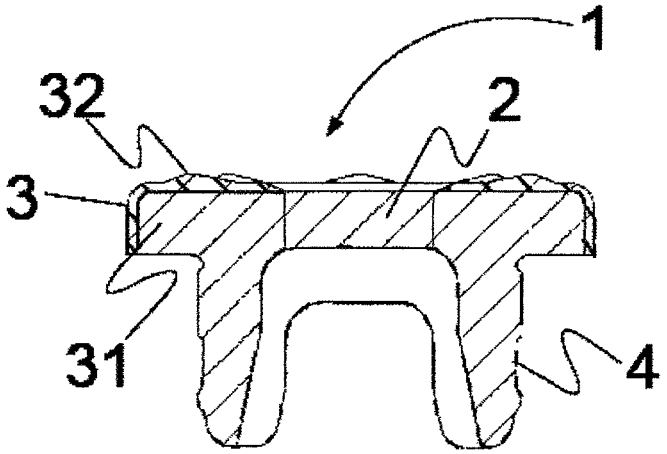
FIG. 5 is a longitudinal sectional view of a vial rubber stopper according to another embodiment of the present invention.

FIG. 1 is a longitudinal sectional view of a vial rubber stopper according to an embodiment of the present invention. FIG. 2 is a longitudinal sectional view of a vial rubber stopper having multiple piercing areas according to an embodiment of the present invention. FIG. 3 is a longitudinal sectional view of a vial rubber stopper according to another embodiment of the present invention. FIG. 4 is a longitudinal sectional view of a vial rubber stopper according to another embodiment of the present invention. FIG. 5 is a longitudinal sectional view of a vial rubber stopper according to another embodiment of the present invention.

The vial rubber stopper 1 of the present invention will be described with FIG. 1 as an example. A cap portion 3 having a flange 31 includes a recess at the center of a top surface, and multiple projections 32 are formed radiating from the recess in a predetermined direction at equal intervals. A piercing area 2 is disposed at the center of the cap portion 3, traversing longitudinally from the recess to a bottom surface. Two cylindrical leg portions 4 extending downward are formed on the bottom surface of the cap portion 3 to surround the piercing area 2. The piercing area 2 is formed of chlorinated butyl rubber containing no clay (rubber having low rubber hardness), and the other portion excluding the piercing area 2 is formed of rubber having high rubber hardness which is obtained by combining 60 parts of clay with 100 parts of chlorinated butyl rubber. By selecting the rubber as mentioned above, the coring will not occur even though a hollow needle pierces therethrough, and the sticking to a presser plate will not happen.

In the above embodiment, chlorinated butyl rubber is used for both the rubber having high rubber hardness and the rubber having low rubber hardness. Since chlorinated butyl rubber has low gas permeability and is free from being deteriorated by medical agents and being eluted by the medical agents, it can be used preferably. The rubber hardness of the rubber stopper 1 is adjusted by formulating clay in chlorinated butyl rubber. Chlorinated butyl rubber is given as an example but not limited thereto, and any rubber may be used if the rubber is rich in airtightness which can be used as the rubber stopper 1 of a vial, and possesses no such bad influences as being deteriorated by the medical agents inside the vial and/or being eluted by the medical agents inside the vial. In addition, the rubber for the top surface of the cap portion 3 of the rubber stopper 1 is not particularly limited if the rubber has the rubber hardness preventing the sticking of the top surface to the presser plate, and the rubber for the piercing area 2 is also not particularly limited if the rubber has the rubber hardness avoiding the occurrence of the coring caused by the piercing of a hollow needle. In the above embodiment, both the top surface of the cap portion 3 and the piercing area 2 are formed of chlorinated butyl rubber; it is acceptable that the top surface of the cap portion 3 and the piercing area 2 are formed of different types of rubber.

For the piercing area 2 in the above embodiment, one recess is formed at the center of the top surface of the cap portion 3, and the piercing area is formed to traverse longitudinally from the recess to the bottom surface of the cap portion 3. However, the recess may not be disposed at the center of the top surface of the cap portion 3, and the recess is not limited to one but in plural numbers. For example as illustrated in FIG. 2, it is acceptable that two recesses are provided at a predetermined interval from the center of the top surface of the cap portion 3 and the piercing area 2 is disposed to traverse longitudinally from each recess to the bottom surface of the cap portion 3. In this case, the piercing area 2 is located inside the area surrounded by the leg portion 4 of the cap portion 3. The configuration of the piercing area 2 having a recess lower than the top surface of the cap portion 3 makes it possible to prevent the piercing area 2 from contacting the presser plate and avoid the sticking of the piercing area to the presser plate.

For the leg portion 4, the shape of the leg portion is not particularly limited if it can keep the vial airtight and/or liquid-tight after it is inserted into an opening of the vial. The leg portion may simply have a cylindrical shape. Preferably, in order to be used as a rubber stopper for a freeze-dried vial, it is acceptable that a portion of the cylindrical body is cut away, and it is also acceptable that a hole is disposed in the type described in the above embodiment, a C-shaped cylindrical body, or a cylinder close to the side of the cap portion 3.

As another embodiment, it is acceptable that the top surface of the cap portion 3 other than the recess and the flange 31 thereof are formed of rubber having the high rubber hardness and the other portion is formed of rubber having the low rubber hardness, as illustrated in FIG. 3; it is also acceptable that the top surface of the cap portion 3 other than the recess and a side portion thereof are formed of rubber having the high rubber hardness and the other portion is formed of rubber having the low rubber hardness, as illustrated in FIG. 4; it is further acceptable that the portion of the top surface of the cap portion 3 other than the recess and the flange, which has no contact with the vial, is formed of rubber having the high rubber hardness and the other portion is formed of rubber having the low rubber hardness, as illustrated in FIG. 5. Particularly, if the rubber stopper is formed as illustrated in FIG. 4 or FIG. 5, only the rubber having the low rubber hardness contacts the vial, which makes it easier to keep the airtightness.

Hereinafter, a production method will be described with the vial rubber stopper in FIG. 1 as an example. Firstly, rubber material having the high rubber hardness is introduced into a first die having a circular doughnut shape, the die is closed and the rubber is semi-vulcanized to offer a primary molding article. Thereafter, the primary molding article is transferred into a second die, rubber material having the low rubber hardness is introduced, the die is closed and the rubber is fully vulcanized to offer the vial rubber stopper. The formulation example of filling agents is listed in Table 1 (the amounts of the constituent components are expressed in parts by weight).

TABLE 1

| | high hardness rubber | low hardness rubber |
|---|---|---|
| chlorinated butyl rubber | 100 | 100 |
| talc | 30 | 30 |
| clay | 60 | 0 |
| hydrated silica powder | 15 | 5 |
| titanium oxide | 2 | 2 |
| carbon black master-batch | 0.12 | 0.12 |
| zinc oxide | 5 | 5 |
| sulfur-containing compound | 1.5 | 1.5 |

With respect to the rubber stoppers obtained according to the formulations in Table 1, after a rubber stopper was capped into a vial, a boundary separation test was performed on 10 samples by pressing the piercing area with a metal rod of ϕ6 mm from the top surface of the rubber stopper with a force of 60 N to confirm whether or not the piercing area separates from the other portion, and the boundary separation was found in none of the 10 samples.

hollowed out and the hollowed portion is filled with the rubber material having the low rubber hardness; thereafter, the die is closed and the rubber is fully vulcanized to offer the vial rubber stopper.

With respect to the rubber stopper obtained according to Table 1, in order to confirm whether or not the sticking to the presser plate in the capping operation and the coring in the piercing operation will occur, a top surface-plate sticking test and a coring test were performed. The result is that neither the rubber stopper stuck to the plate nor the coring occurred.

<Top Surface-Plate Sticking Test>

The rubber stopper was half capped into each of 25 vials with SUS#400 plate, and after being kept under a pressing pressure of 5.0 Kgf/cm$^2$ for 15 minutes, the SUS plate was elevated. At this moment, the interval from a time when the stuck vial was elevated to a time when the vial fell and the number of tilted vials were counted.

With respect to the rubber stoppers obtained according to Table 1, none stuck to the plate. Since none stuck to the plate, the number of tilted vials was zero.

<Coring Test>

For 10 rubber stoppers, a hollow needle (18G11/2' RB metal needle produced by Nipro) was pierced through the piercing area of each rubber stopper at a speed of 3000 mm/min for 50 times, whether or not rubber pieces and rubber notches are present was confirmed.

With respect to the vial rubber stoppers obtained according to Table 1, the rubber hardness was measured by using a micro rubber hardness gauge MD-1 capa (by KOBUNSHI KEIKI CO., LTD.). The rubber hardness of the piercing area was 30 and the rubber hardness of the portions other than the piercing area was 65.

In addition to the above formulations, the vial rubber stopper was made by using various types of rubber. The formulation example of filling agents is listed in Table 2 (the amounts of the constituent components are expressed in parts by weight). The vial rubber stopper was made by using the types of rubber listed in Table 2 as a rubber having the high rubber hardness and a rubber having the low rubber hardness, respectively.

TABLE 2

| | formulation A | formulation B | formulation C | formulation D | formulation E | formulation F | formulation G |
|---|---|---|---|---|---|---|---|
| chlorinated butyl rubber | 100 | 100 | 100 | 100 | 100 | 100 | 100 |
| talc | 25 | 25 | 50 | 60 | 65 | 25 | 30 |
| silica | 5 | 10 | — | — | — | 25 | — |
| UHMWPE | — | — | 5 | 10 | 15 | 10 | 60 |
| titanium oxide | 1 | 1 | 2 | 1 | 1 | 1 | 1 |
| carbon black master-batch | 0.12 | 0.12 | 0.12 | 0.12 | 0.12 | 0.12 | 0.12 |
| hydrotalcite | 7 | 7 | 7 | 7 | 7 | 7 | 7 |
| sulfur-containing urea vulcanizing agent | 0.7 | 0.8 | 1 | 1 | 1 | 1 | 1 |

UHMWPE = Ultra high molecular weight polyethylene

The production method is not limited to the above, and the rubber stopper may be produced according to various production methods. For example, once after the rubber having the high rubber hardness is obtained through semi-vulcanization, the portion corresponding to the piercing area is With respect to the rubber stoppers in the above, the top surface-plate sticking test and the coring test were performed similarly. The rubber hardness of formulations A to G and the results of the tests were listed in Table 3. The rubber hardness exhibiting the effect of preventing the sticking to the presser plate is from 58 to 90, and the rubber hardness without occurrence of the coring is from 20 to 35. Thereby, the rubber hardness from 20 to 90 holds the value capable of exhibiting the rubber functions.

TABLE 3

| | formulation A | formulation B | formulation C | formulation D | formulation E | formulation F | formulation G |
|---|---|---|---|---|---|---|---|
| rubber hardness | 30 | 35 | 40 | 43 | 47 | 50 | 58 |
| number of tilted vials | 15 | 9 | 2 | 1 | 3 | 9 | 0 |
| coring occurrence number | 0 | 0 | 2 | 19 | 33 | 34 | 50 |

INDUSTRIAL APPLICABILITY

As mentioned above, since the vial rubber stopper of the present invention is free from sticking to the presser plate and the occurrence of the coring, it is preferably applicable to medical services.

REFERENCE SIGNS LIST

1: rubber stopper; 2: piercing area; 3: cap portion; 4: leg portion

The invention claimed is:

1. A vial rubber stopper comprising:

a cap portion having a top surface with at least one opening, a bottom surface and a flange;

at least one piercing portion recessed downwardly from the top surface of the cap portion to form a recess, said recess having a sidewall inwardly tapered from the top surface of the cap portion toward a central axis of the at least one piercing portion, the at least one piercing portion being configured to traverse said cap portion from the at least one opening to the bottom surface of the cap portion in an axial direction along a central axis of the cap portion; and a leg portion extending downward from the bottom surface of the cap portion and having a recess wider than the top surface of the at least one piercing portion, wherein the top surface of the cap portion is formed of rubber having a Type A rubber hardness from 58 to 90, wherein the at least one piercing portion, the bottom surface of the cap portion and the leg portion are formed of rubber having a Type A rubber hardness from 20 to 35, wherein the cap portion, the at least one piercing portion and the leg portion are unitarily formed as one piece, and wherein the flange of the cap portion is the entire portion, which extends out of an outer diameter of the leg portion, of the cap portion, and includes a first portion made of the rubber having the Type A rubber hardness from 58 to 90 and a second portion made of the rubber having the Type A rubber hardness from 20-35.

2. A vial rubber stopper comprising:

a cap portion having a top surface with at least one opening, a bottom surface and a flange;

at least one piercing portion recessed downwardly from the top surface of the cap portion to form a recess, said recess having a sidewall inwardly tapered from the top surface of the cap portion toward a central axis of the at least one piercing portion, the at least one piercing portion being configured to traverse said cap portion from the at least one opening to the bottom surface of the cap portion in an axial direction along a central axis of the cap portion; and a leg portion extending downward from the bottom surface of the cap portion and having a recess wider than the top surface of the at least one piercing portion, wherein the cap portion, the at least one piercing portion and the leg portion are unitarily formed as one piece, wherein the top surface of the cap portion and a side surface of the flange are formed of rubber having a Type A rubber hardness from 58 to 90, the flange being the entire portion, which extends out of an outer diameter of the leg portion, of the cap portion, and wherein the at least one piercing portion, the bottom surface of the cap portion and the leg portion are formed of rubber having a Type A rubber hardness from 20 to 35.

3. A vial rubber stopper comprising:

a cap portion having a top surface with at least one opening, a bottom surface and a flange;

at least one piercing portion recessed downwardly from the top surface of the cap portion to form a recess, said recess having a sidewall inwardly tapered from the top surface of the cap portion toward a central axis of the at least one piercing portion, the at least one piercing portion being configured to traverse said cap portion from the at least one opening to the bottom surface of the cap portion in an axial direction along a central axis of the cap portion; and a leg portion extending downward from the bottom surface of the cap portion and having a recess wider than the top surface of the at least one piercing portion, wherein the cap portion, the at least one piercing portion and the leg portion are unitarily formed as one piece, wherein the top surface of the cap portion and the flange are formed of rubber having a Type A rubber hardness from 58 to 90, the flange being the entire portion, which extends out of an outer diameter of the leg portion, of the cap portion, and wherein the at least one piercing portion and the leg portion are formed of rubber having a Type A rubber hardness from 20 to 35.

4. The vial rubber stopper according to claim 1, wherein the top surface of the cap portion includes two openings, the at least one piercing portion includes two piercing portions, each corresponding to one of the two openings, and each of the two piercing portions includes a top surface narrower than the corresponding opening.

5. The vial rubber stopper according to claim 2, wherein the top surface of the cap portion includes two openings, the at least one piercing portion includes two piercing portions, each corresponding to one of the two openings, and each of the two piercing portions includes a top surface narrower than the corresponding opening.

6. The vial rubber stopper according to claim 3, wherein the top surface of the cap portion includes two openings, the at least one piercing portion includes two piercing portions, each corresponding to one of the two openings, and each of the two piercing portions includes a top surface narrower than the corresponding opening.

* * * * *